US006352360B1

(12) United States Patent
Yamada

(10) Patent No.: US 6,352,360 B1
(45) Date of Patent: Mar. 5, 2002

(54) CONTINUOUS MIXING PLANT

(75) Inventor: Kazuie Yamada, Saitama (JP)

(73) Assignee: Japan Institute of Construction Engineering, Tokyo (JP)

( * ) Notice: Subject to any disclaimer, the term of this patent is extended or adjusted under 35 U.S.C. 154(b) by 0 days.

(21) Appl. No.: 09/674,702

(22) PCT Filed: Mar. 8, 1999

(86) PCT No.: PCT/JP99/01114

§ 371 Date: Nov. 3, 2000

§ 102(e) Date: Nov. 3, 2000

(87) PCT Pub. No.: WO00/53302

PCT Pub. Date: Sep. 14, 2000

(51) Int. Cl.[7] ..... B01F 5/00; B01F 15/02; B01F 15/04

(52) U.S. Cl. ..... 366/9; 366/17; 366/18; 366/29; 366/31

(58) Field of Search ..... 366/8, 9, 16, 17, 366/18, 21, 341, 183.1, 183.2, 151.1, 152.1, 336, 109, 27, 28, 29, 31

(56) References Cited

U.S. PATENT DOCUMENTS

| | | | | |
|---|---|---|---|---|
| 3,317,191 A | | 5/1967 | Brown et al. | |
| 3,917,236 A | * | 11/1975 | Hanson | 366/9 |
| 3,963,221 A | | 6/1976 | Yi | 366/141 |
| 3,977,657 A | | 8/1976 | Shearer et al. | |
| 4,089,509 A | * | 5/1978 | Morton et al. | 366/17 |
| 4,618,294 A | | 10/1986 | Brown | |
| 4,889,433 A | * | 12/1989 | Pratt | 366/17 |
| 5,452,954 A | * | 9/1995 | Handke et al. | 366/16 |
| 5,492,409 A | | 2/1996 | Karlsson et al. | |
| 5,590,976 A | * | 1/1997 | Kilheffer et al. | 366/183 |

FOREIGN PATENT DOCUMENTS

| | | |
|---|---|---|
| EP | 0 796 650 | * 9/1997 |
| JP | 48-54364 | 10/1971 |
| JP | 51-24080 | 7/1976 |
| JP | 62-168529 | 7/1987 |
| JP | 2-22030 | 6/1990 |
| JP | 10-286449 | 10/1998 |

* cited by examiner

*Primary Examiner*—Tony G. Soohoo
(74) *Attorney, Agent, or Firm*—Burr & Brown

(57) ABSTRACT

A continuous mixing plant that, for example simply continuously feeds the necessary materials while metering the amount thereof and drops these materials by gravitational force so that the mixed material may be manufactured continuously. As a means for attaining this object, a continuous mixing plant comprising a continuous metering and feeding means for feeding at least two kinds of materials to be mixed with each other while continuously metering the materials, and at least one mixing box unit for mixing the materials, is characterized in that the mixing box unit is provided with: a plurality of modified passages each of which has an inlet at one end and an outlet at the other end and a cross-sectional shape of which is continuously changed from the inlet toward the outlet and which extend in an axial direction; and a merging and dividing means.

7 Claims, 10 Drawing Sheets

CONTINUOUS MIXING PLANT

TECHNICAL FIELD

The present invention relates to a continuous mixing plant, and more particularly to a continuous mixing plant that is suitable for continuously producing concrete for a short period of time simply by, for example, continuously feeding necessary material while measuring it and dropping the material by gravitational force.

BACKGROUND ART

Conventionally, a batcher plant that is an apparatus for producing concrete is equipment for mixing cement, water, sand, rough sand, mixer agent and the like for the material of the concrete measured in a predetermined composition for producing the concrete that is kept in non-solid condition, and has been widely used in a dam construction, a civil construction, a green concrete factory, a concrete secondary factory or the like.

The conventional batcher plant is roughly composed of a material reservoir portion, a metering portion, a kneading portion and a loading portion. The batcher plants are divided into various types in accordance with these arrangements. The most typical system is of a tower type as shown in FIG. 11. The conventional tower type batcher plant 1 shown in FIG. 11 is a system in which a receiving chamber 2, a material reservoir 3 (a cement reservoir 3*a,* a sand reservoir 3*b,* a small stone reservoir 3*c,* a water reservoir 3*d*), a metering portion 4 (a cement metering tank 4*a,* a sand metering tank 4*b,* a small stone metering tank 4*c*), a concrete mixer 5, a concrete hopper 6 and the like are overlapped in order in a tower-like shape from above. A type in which an operating chamber 7 projects from a metering or mixer chamber 8 and a type in which an operating chamber 7 is separated from the plant are popular.

Thus, almost all of the conventional batcher plants including that shown in FIG. 11 are of a batch processing type (the process in which a predetermined amount of materials is mixed and agitated every time, and this is repeated). Then, one for metering and agitating the materials for every turn is called a batch mixer.

However, in such a batch process, the manufacture of concrete is intermittent and such a process is not so effective for continuously producing a large amount of concrete. For this reason, in the conventional tower type batcher plant 1 as shown in FIG. 11, two concrete mixers 5 are arranged within the mixer chamber 8, and these are alternately used in order to keep the continuation or continuity of the concrete manufacture as much as possible.

Even in a batch process, if the plurality of concrete mixers 5 are arranged as described above and are used in order, it is possible to keep continuous manufacture to some extent. However, there is a problem that the more the number of the installed mixers 5, the larger the equipment of the batcher plant as a whole will become.

By the way, it is desired to continuously perform the manufacture of concrete in this manner. It is however very difficult to continuously mix the materials in an optimal manner. Actually, a mixing apparatus, i.e., a mixer that is actually usable effectively has not yet been realized. Also, even if such a continuous mixer is developed, there is a problem as to how the amount of each material to be continuously introduced into the mixer is metered for manufacturing a high quality concrete. Also in view of this point, it is considered impossible to perform the effective continuous manufacture of concrete.

In order to overcome the above-described problems inherent in the prior art, an object of the present invention is to provide a continuous mixing plant that, for example, simply continuously feeds the necessary materials while metering the amount thereof and drops these materials by gravitational force so that the mixed material may be manufactured continuously for a short period of time suitably, and in the case where the mixed material is concrete, it is possible to manufacture higher quality concrete continuously for a short period of time while accurately continuously metering each material and feeding it to the mixer.

DISCLOSURE OF THE INVENTION

The present invention relates to a continuous mixing plant. In order to solve the above-described problems, the invention is constituted as follows. Namely, according to the present invention, there is provided a continuous metering and feeding means for keeping on feeding at least two kinds of materials to be mixed with each other while continuously metering the materials, the number of the continuous metering and feeding means being the number corresponding to the materials, and at least one mixing box unit for mixing the materials fed continuously from the continuous metering and feeding means, characterized in that the mixing box unit is provided with: a plurality of modified passages each of which has an inlet at one end and an outlet at the other end, a cross-sectional shape of which is continuously changed from the inlet toward the outlet and which extend in an axial direction; and a merging and dividing means provided between the inlet and the outlet of each of the modified passages for merging and dividing each material passing through each of the modified passages, and each material is continuously cast from the inlet portion and passed toward the outlet portion through each of the modified passages by the gravitational force to be mixed.

In the continuous mixing plant according to the present invention, it is preferable that the plant further comprises a metering means for metering a delivery amount locally and for every predetermined time in a midway for continuously delivering the material fed from each of the continuous metering and feeding means, and the continuous metering and feeding means receives a signal from this metering means to be feedback-controlled, thereby enhancing precision of the material supply amount.

In such a continuous mixing plant, at least two materials to be mixed are an aggregate and mortar, or cement paste, and the mixing plant is applied as a plant for continuously manufacturing concrete.

A continuous mixing plant according to the present invention may further take the following structure. Namely, there is provided a continuous mixing plant comprising a main belt conveyor unit for delivering aggregate; a continuous aggregate feeding means for keeping on feeding at least one kind of aggregate to the main belt conveyor unit while metering the material; a first detecting unit installed downstream of a delivery belt of the main belt conveyor unit for metering continuously at a predetermined position a local amount of the aggregate that has been transferred on the delivery belt of the main belt conveyor unit, thereby outputting a signal; a continuous fixed amount supply means installed downstream of the main belt conveyor unit having the aggregate fed for keeping on feeding a fixed amount of mortar or cement paste continuously to the main belt conveyor unit; and at least one mixing box unit disposed just below a delivery end of the main belt conveyor unit, characterized in that the continuous fixed amount supply unit receives the signal continuously output from the first detecting unit and is feedback-controlled to enhance precision of the supply amount of the mortar or cement paste, and that, furthermore the mixing box unit is provided with: a plurality of modified passages each of which has an inlet portion at one end and an outlet portion at the other end, a cross-sectional shape of which is continuously changed from the inlet portion toward the outlet portion, and which extend in an axial direction; and a merging and dividing means provided between the inlet portion and the outlet portion of each of the modified passages for merging and dividing concrete passing through each of the modified passages and concrete is cast from the inlet portion and passed toward the outlet portion through each of the modified passages by the gravitational force to be mixed.

Although the continuous mixing plant according to the present invention comprises the above-described necessary structural elements, it is possible to establish the invention even when the structural elements are specifically as follows. Namely, the continuous aggregate feeding means includes: a belt conveyor unit for feeding the aggregate to the main conveyor unit; a material delivering unit for continuously feeding the aggregate to the belt conveyor unit; and a second detecting unit installed downstream of the belt conveyor unit so as to output a signal by continuously metering at a predetermined position an amount of the aggregate that is transferred on the delivery belt of the belt conveyor unit, the material delivering unit being feedback-controlled upon receiving the signal continuously outputted from the second detecting unit, to thereby enhance precision of the supply amount of the aggregate delivered and fed to the belt conveyor unit.

Also, the continuous mixing plant according to the present invention is characterized in that the material delivering unit includes a vibrating feeder, and a frequency of the vibrating feeder is changed on the basis of the signal continuously output from the second detecting unit to feedback-control the cutting amount of the aggregate to the belt conveyor unit.

Furthermore, the continuous mixing plant according to the present invention is characterized in that one or both of the first and second detecting units are composed of a belt scale unit for continuously metering a weight of the delivery belt as a whole at a predetermined position.

Furthermore, the continuous mixing plant according to the present invention is characterized in that the mixing box unit is constituted by connecting a plurality of elements substantially in a vertical direction, each of the elements is provided with an inlet end, an outlet end and the plurality of modified passages stretching from the inlet end to the outlet end, the inlet of each of the modified passages formed at the inlet end and the outlet of each of the modified passages formed at the outlet end have different arrangement patterns, furthermore, each adjacent elements are connected in intimate contact with each other at the outlet end and the inlet end, and a joint portion between the inlet and the outlet of each of the modified passages on the end portion of the joint side of each of the elements constitutes the merging and dividing means.

Incidentally, in the continuous mixing plant according to the present invention, it is preferable that the elements are provided with rectangular openings being arranged on the right and left sides as an arrangement pattern of the inlet of each of the modified passages and with rectangular openings being arranged vertically as an arrangement pattern of the outlet of each of the modified passages, and are constituted of at least two kinds to differentiate the communication state between each inlet and each outlet of each of the modified passages, and the mixing box unit is constituted by connecting alternately the different kinds of the elements with each other in the vertical direction.

In the continuous mixing plant according to the present invention, it is preferable that an openable/closeable cut gate is provided at an outlet of the lowermost element constituting the mixing box unit, and a discharge amount of material dropping by a gravitational force is adjusted, whereby control of a filling rate of the material in the modified passage of each element of the mixing box unit is performed.

In the thus structured continuous mixing plant according to the present invention, each material is fed continuously from the continuous supply means while being metered and caused to fall into the mixing box unit. Namely, when each material is continuously cast into the plurality of the modified passages on the inside from the inlet end located above the mixing box unit, the material is caused to fall through each modified passage by the gravitational force.

Each modified passage has a cross-sectional shape continuously varying in its longitudinal direction. The material falling through this modified passage is subjected to a compressive deformation effect and is mixed. In addition, the material passing through each modified passage is merged by passing through the dividing and merging means during a fall through this modified passage. Then, the material is divided (division) into each modified passage and falls. Preferably, this is repeated to perform the good mixture.

In such a mixing box unit, in general, a plurality of elements are connected with each other so as to overlap in the vertical direction and thus, a dividing and merging effect can be inevitably obtained. The element is provided with an inlet end, an outlet end and a plurality of modified passages from the inlet end to the outlet end. The arrangement pattern of the inlet of each of the modified passages formed in the inlet end is different from the arrangement pattern of the outlet of each of the modified passages formed in the outlet end.

If the elements are connected to each other in intimate contact with each other at the outlet end and the inlet end of the adjacent elements, the joint portion of the inlet and the outlet of each of the modified passages of each element forms the merging and dividing means. Incidentally, in the case where the element in which the rectangular openings are arranged on the right and left as the arrangement pattern of the inlet of each of the modified passages and the rectangular openings are arranged vertically as the arrangement pattern of the outlet is used, if at least two kinds of elements that have different communication states between each inlet and each outlet of each of the modified passages are prepared and the different kinds of elements are connected in the vertical direction alternately to form the mixing box unit, the linear communication portion from the upper inlet end to the lower outlet end of the mixing box unit is shortened or eliminated whereby the mixture effect of the falling material is enhanced.

For instance, this continuous mixing plant may be used as a plant for manufacturing the concrete. In this case, in particular, to obtain a high quality concrete, it is preferable that the supply amount of the aggregate to be fed from the material delivering unit constituting the continuous aggregate feeding means is detected by the detecting unit to perform the feedback control to enhance the precision of the supply amount. Alternately, in the case where at least one kind of aggregate is fed to the mixing box unit by the main conveyor unit, it is preferable that the amount of the aggregate to be continuously fed by the main conveyor unit is detected in order by the detecting unit so as to feed the mortar or cement paste from the continuous fixed amount supply unit to the main conveyor unit.

BEST MODE FOR CARRYING OUT THE INVENTION

Figure 1:
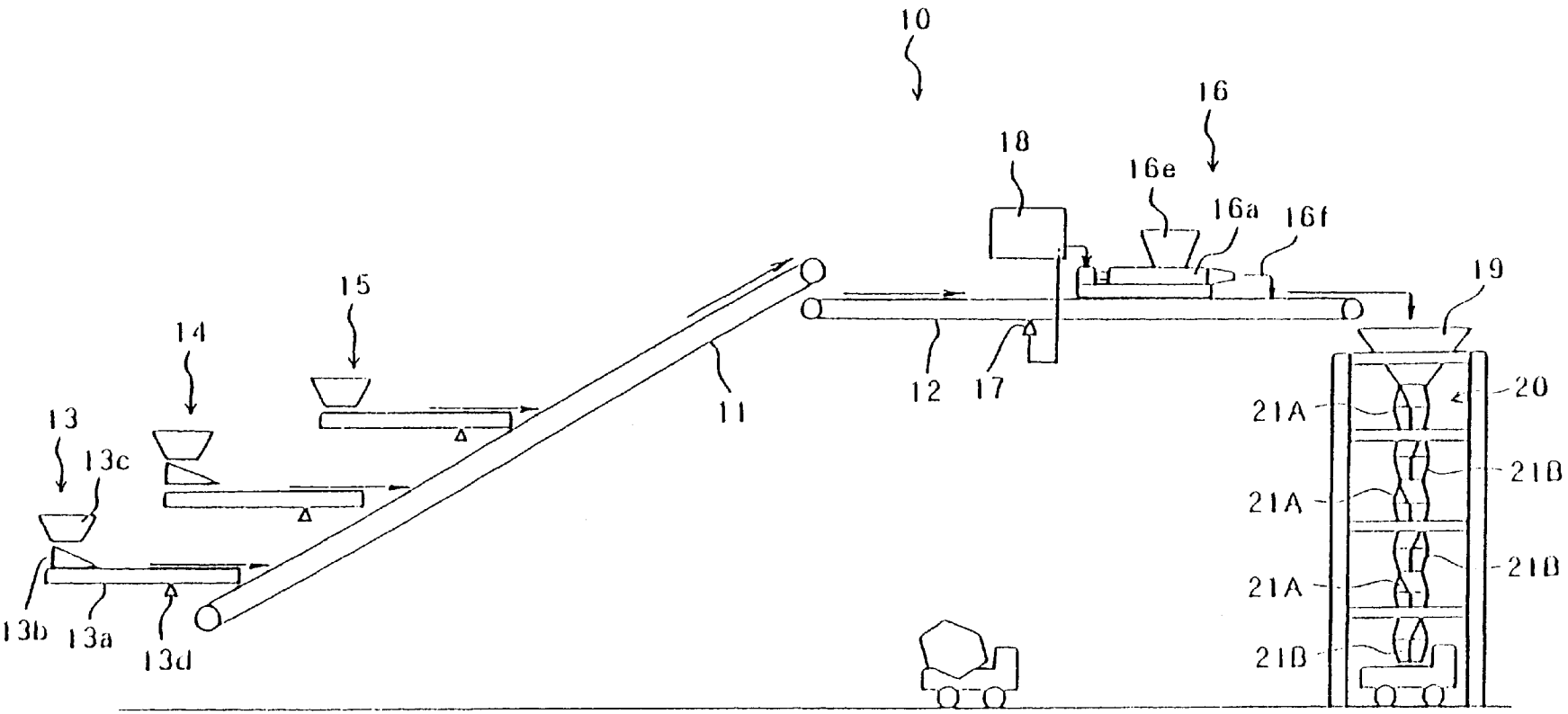
FIG. 1 is a schematic structural view showing a continuous concrete manufacturing plant in accordance with an embodiment of the present invention.
Figure 2:
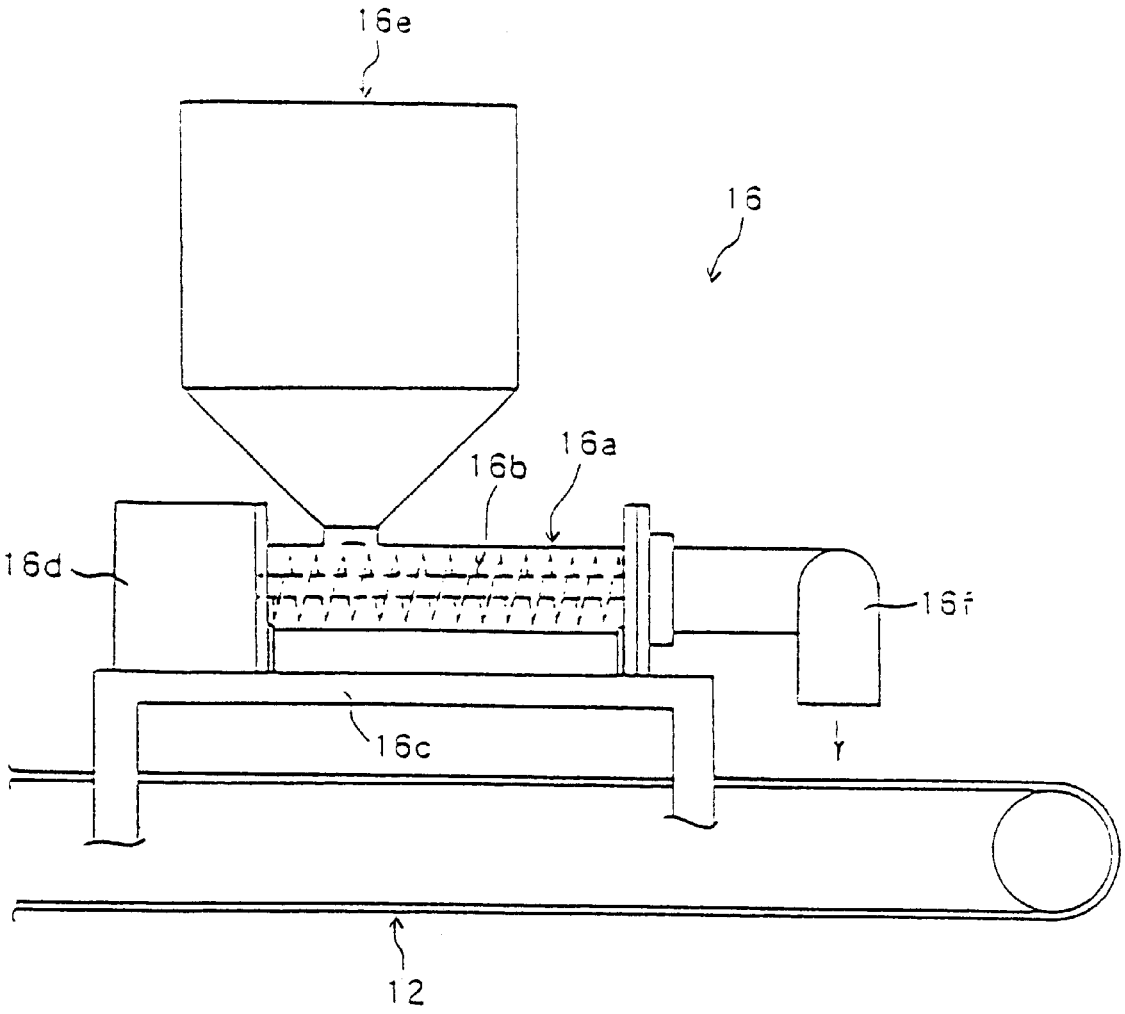
FIG. 2 is a partially fragmentary frontal view of a unit for metering and feeding mortar or cement paste to a second main belt conveyor unit in the continuous concrete manufacturing plant shown in FIG. 1.

A continuous mixing plant according to the present invention will now be described with reference to the embodiment shown in the drawings. FIG. 1 is a schematic structural view showing a continuous concrete manufacturing plant in accordance with the embodiment of the present invention. FIG. 2 is a partially fragmentary frontal view of a continuous fixed amount supply unit for feeding mortar or cement paste to a main belt conveyor unit.

Figure 3:
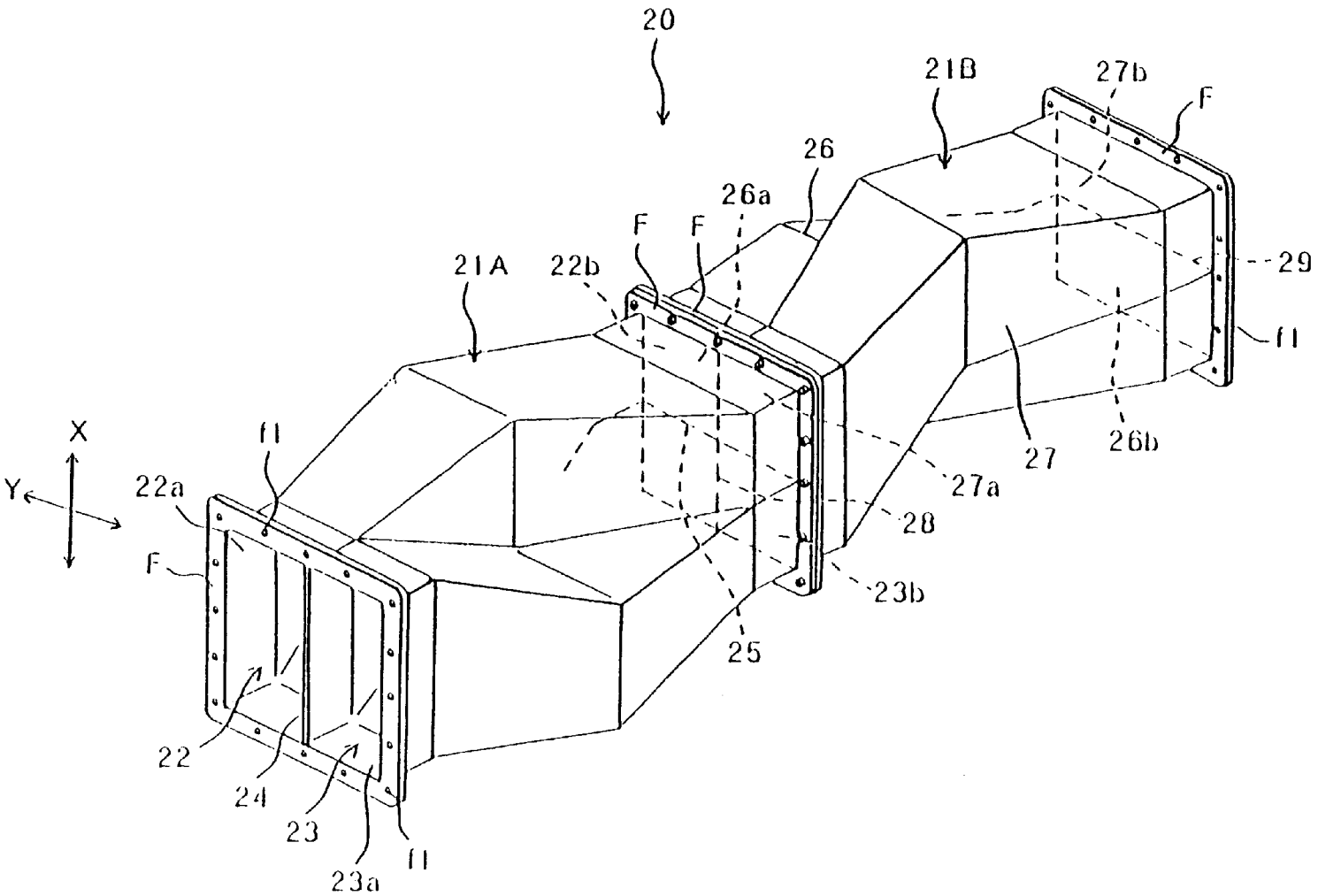
FIG. 3 is a perspective view showing a state in which two different kinds of elements are connected to each other for a mixing box unit to be used in the continuous concrete manufacturing plant shown in FIG. 1.
Figure 4:
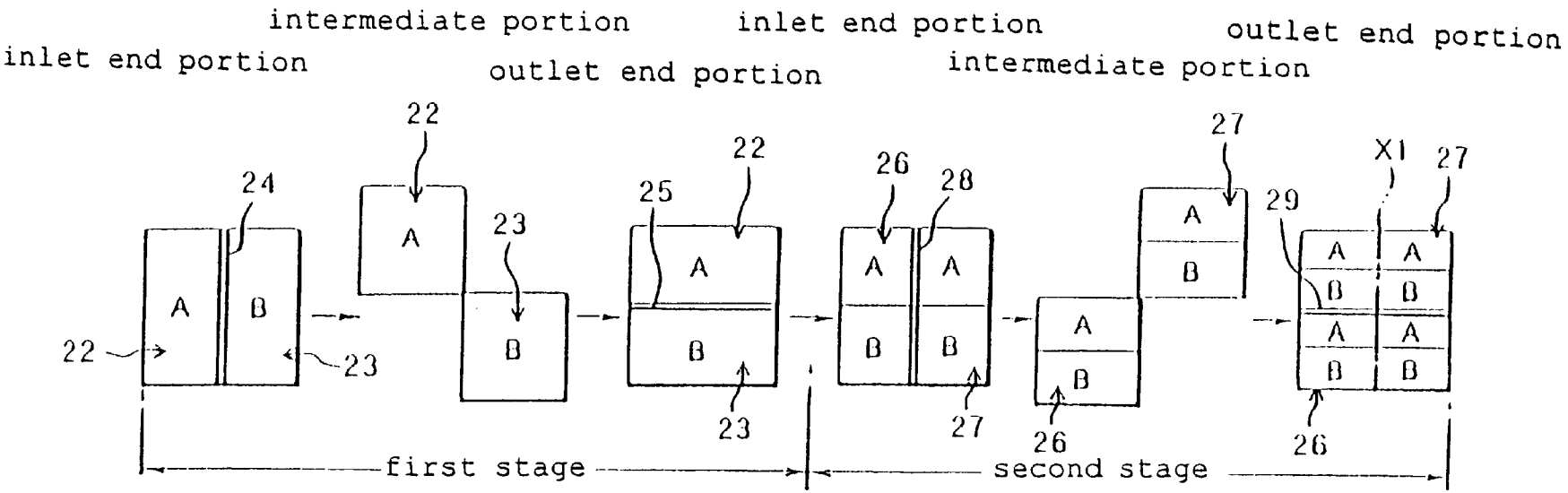
FIG. 4 is a process view showing, like a model diagram, changing states of cross-sections of the object material to be mixed in the case where the two elements are connected to each other as shown in FIG. 3, at an inlet end portion, an intermediate portion and an outlet end portion of each element.

Also, FIG. 3 is a perspective view showing a state in which two different kinds of elements are connected to each other for a mixing box unit to be used in the continuous concrete manufacturing plant shown in FIG. 1. FIG. 4 is a process view showing, like a model diagram, changing states of cross-sections of the object material to be mixed in the case where the two elements are connected to each other, at an inlet end portion, an intermediate portion and an outlet end portion of each element.

Figure 5:
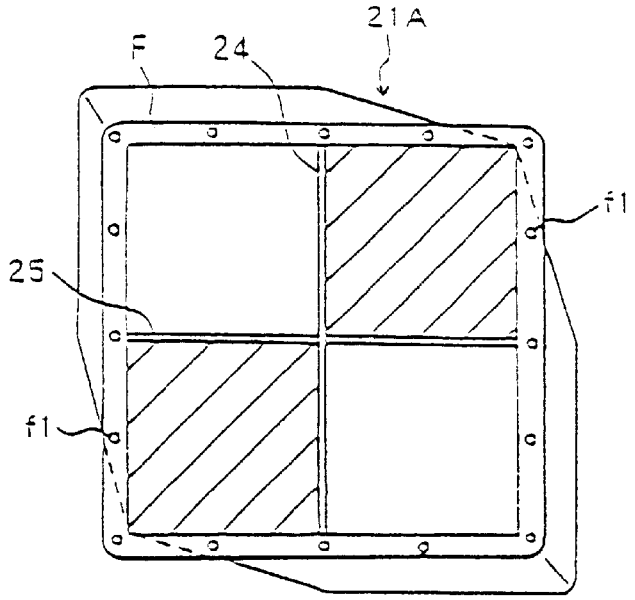
FIG. 5 is a plan view schematically showing each modified passage in the interior of one kind of the elements shown in FIG. 3, as viewed from the inlet end portion.
Figure 6:
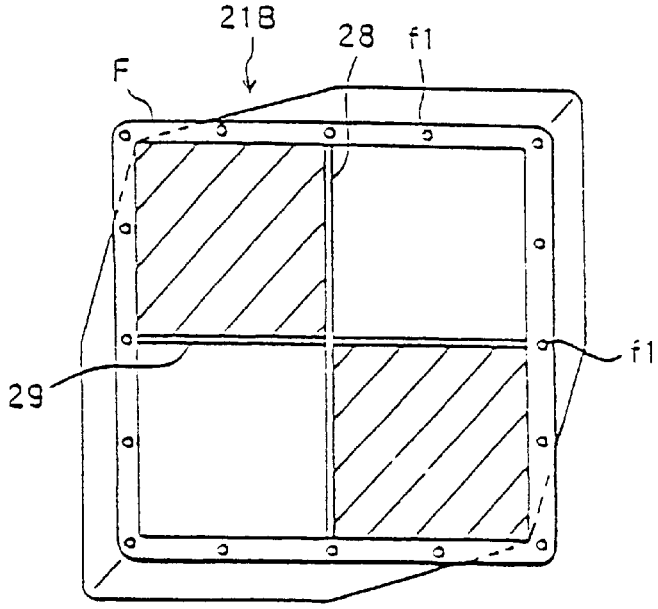
FIG. 6 is a plan view schematically showing each modified passage in the interior of the other kind of the elements shown in FIG. 3, as viewed from the inlet end portion.
Figure 7:
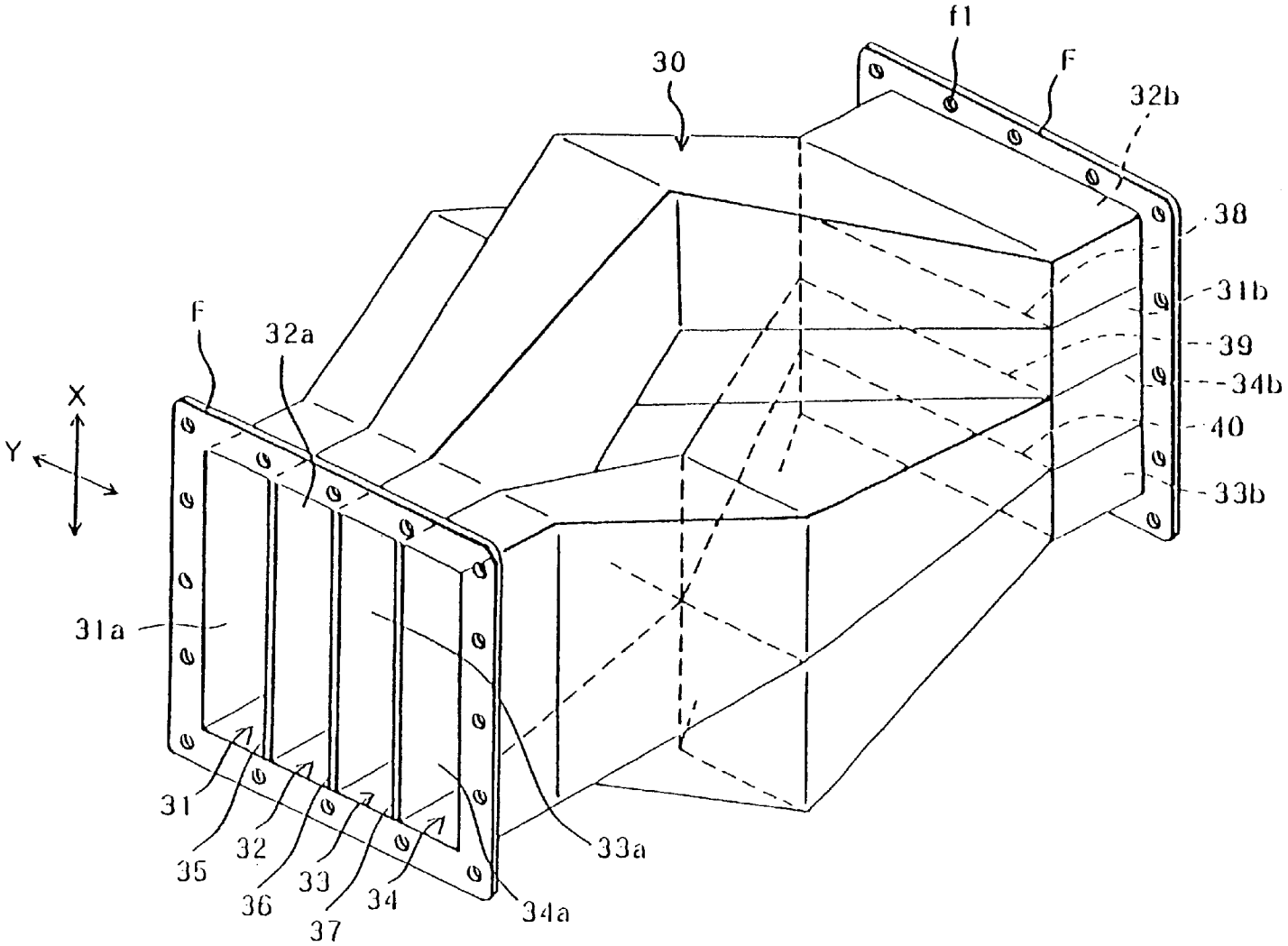
FIG. 7 is a perspective view showing the element, i.e., an element provided in its interior with four modified passages in another mixing box unit to be usable in the continuous concrete manufacturing plant in accordance with the present invention.

Furthermore, FIG. 5 is a plan view schematically showing each modified passage in the interior of one kind of the elements in the mixing box unit, as viewed from the inlet end portion. FIG. 6 is a plan view schematically showing each modified passage in the interior of the other kind of the elements, as viewed from the inlet end portion. FIG. 7 is a perspective view showing the element, i.e., an element provided in its interior with four modified passages in another mixing box unit to be usable in the continuous concrete manufacturing plant in accordance with the present invention.

Figure 8:
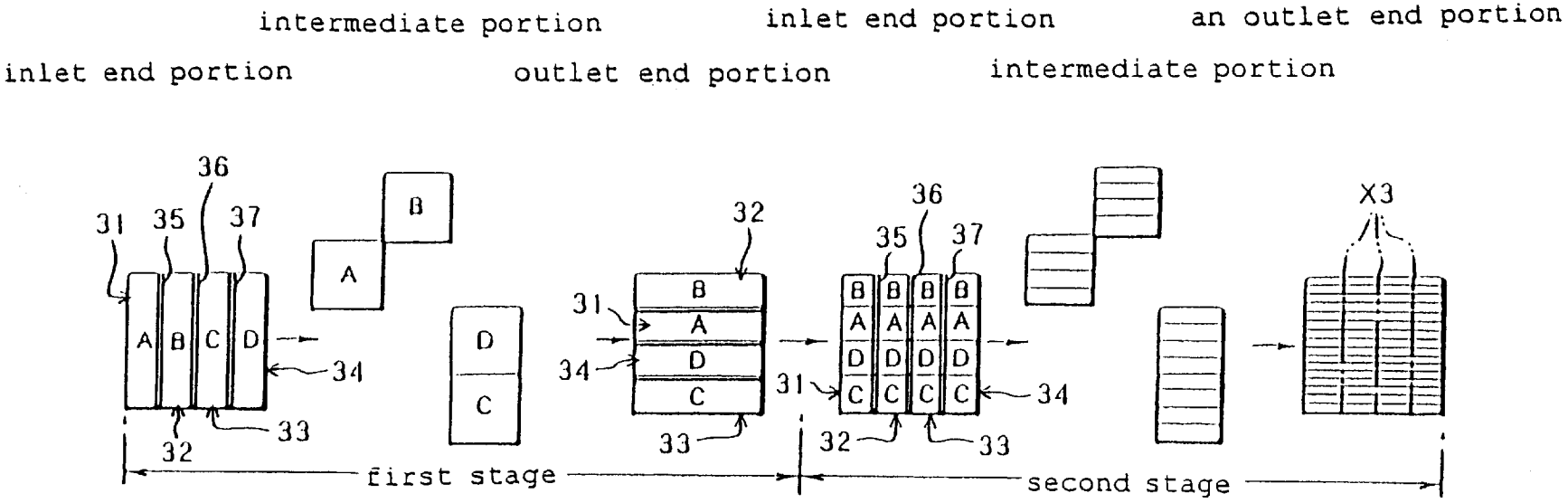
FIG. 8 is a process view showing, like a model diagram, changing states of cross-sections of the object material to be mixed in the case where the two elements shown in FIG. 7 are connected to each other, at an inlet end portion, an intermediate portion and an outlet end portion of each element.
Figure 9:
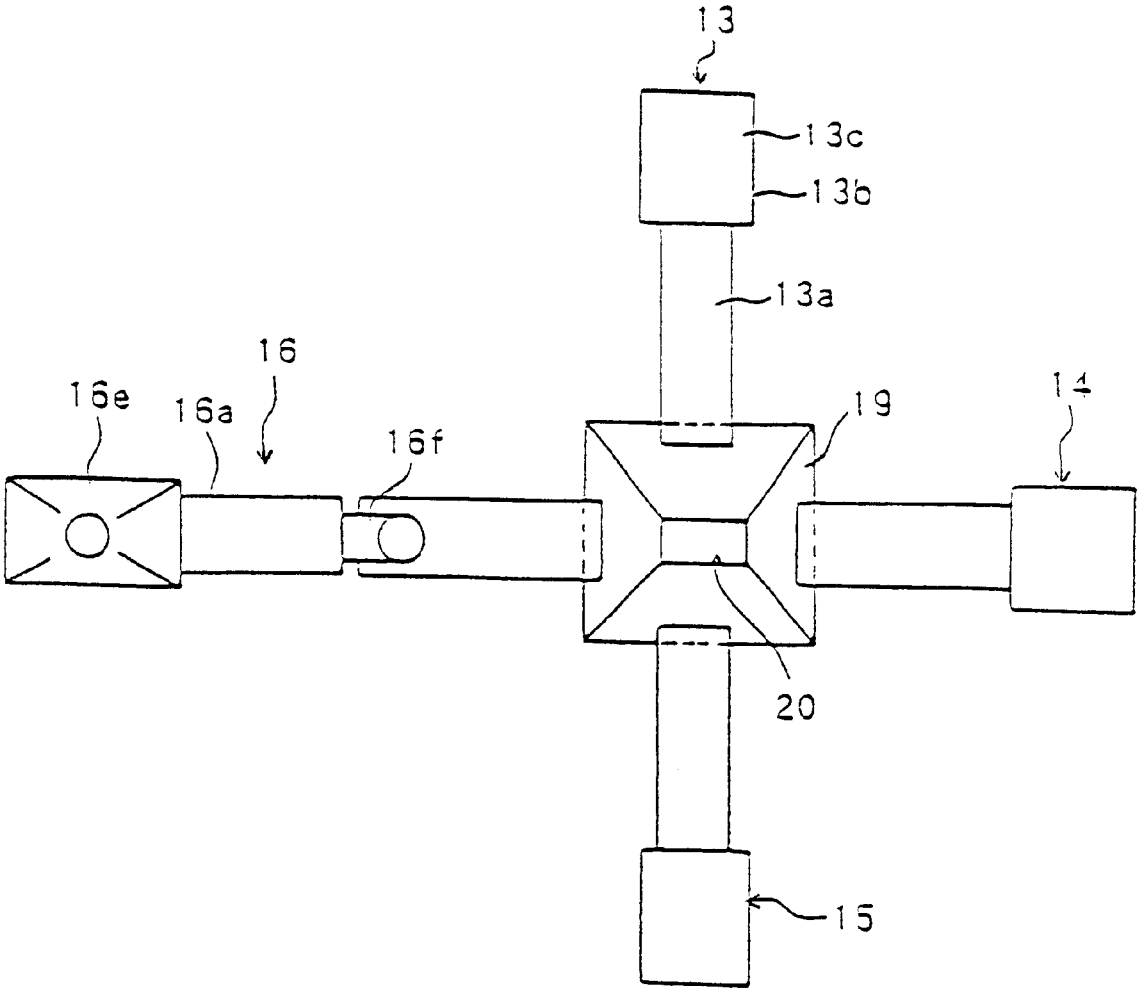
FIG. 9 is a schematic structural view of another embodiment of a continuous mixing plant according to the present invention as viewed from above.
Figure 10:
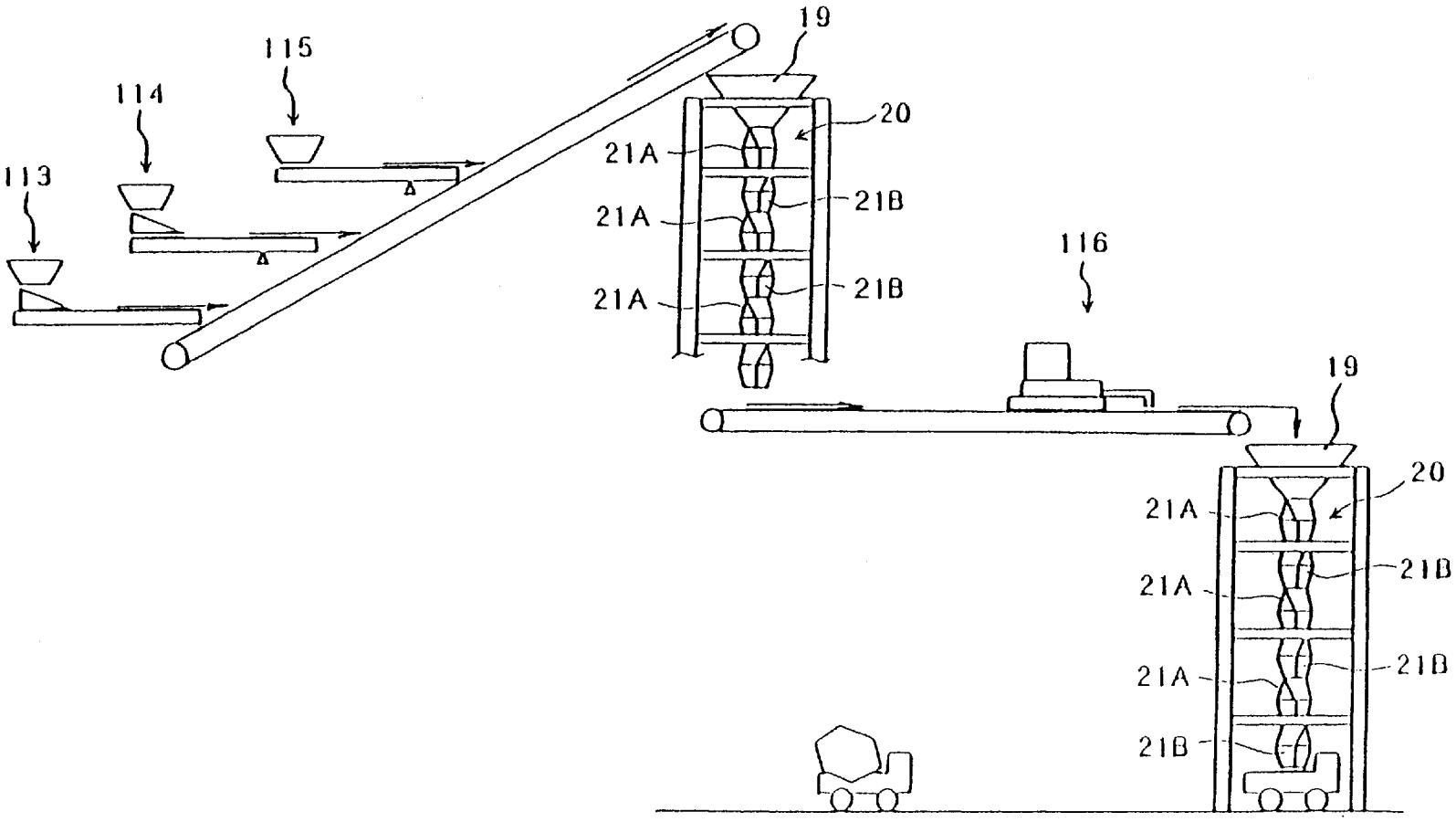
FIG. 10 is a schematic structural view of still another embodiment of a continuous mixing plant according to the present invention.
Figure 11:
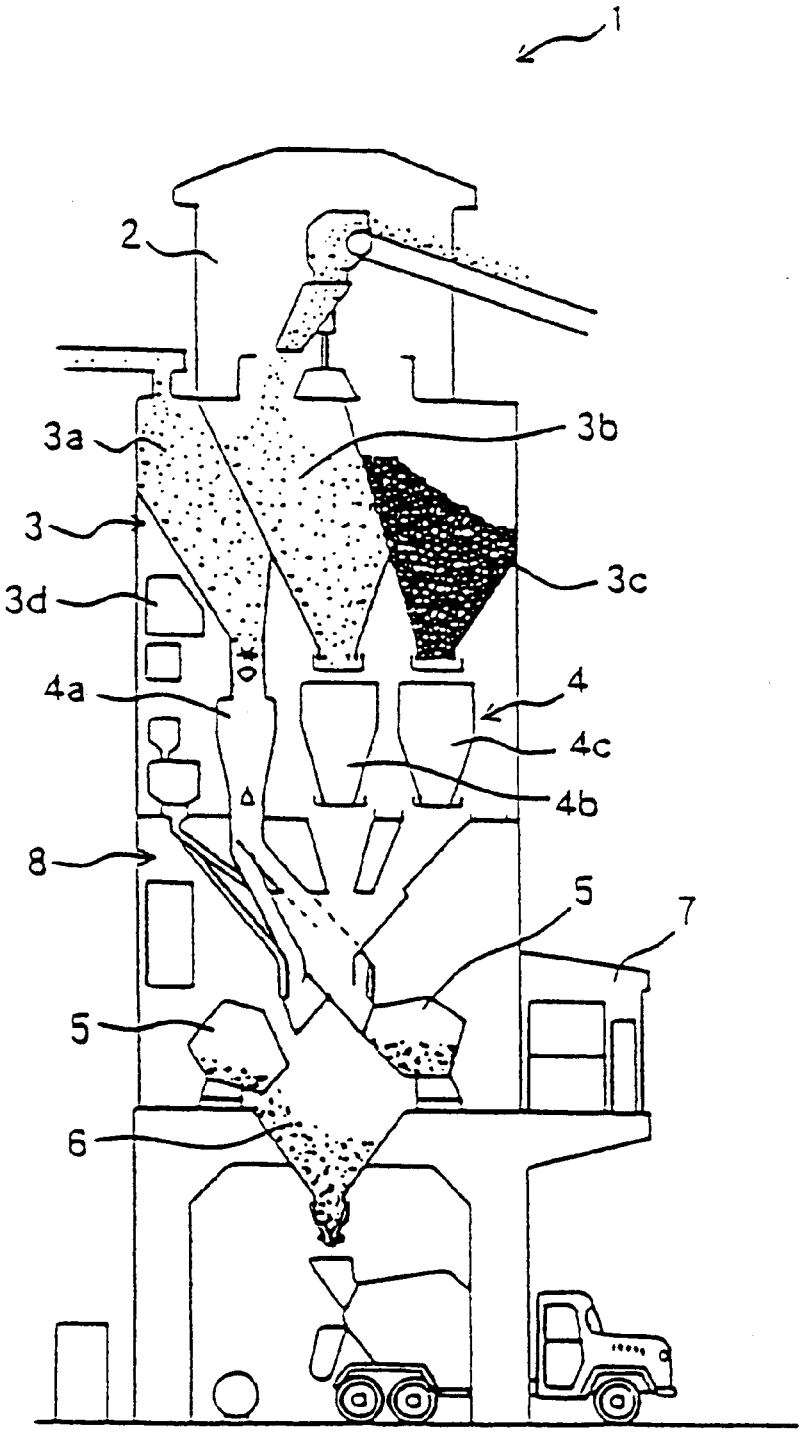
FIG. 11 is a schematic structural view showing a conventional batch processing type batcher plant.

FIG. 8 is a process view showing, like a model diagram, changing states of cross-sections of the object material to be mixed in the case where the two elements shown in FIG. 7 are connected to each other, at an inlet end portion, an intermediate portion and an outlet end portion of each element. FIG. 9 is a schematic structural view of another embodiment of a continuous mixing plant according to the present invention as viewed from above. FIG. 10 is a schematic structural view of still another embodiment of a continuous mixing plant according to the present invention. FIG. 11 is a schematic structural view showing a conventional batch processing type batcher plant.

The continuous concrete manufacturing plant 10 according to this embodiment includes a first main belt conveyor unit 11 installed slantwise and a second main belt conveyor unit 12 installed horizontally. These two main belt conveyor units 11 and 12 are adapted to continuously deliver the material in a ride-on manner.

In the first main belt conveyor unit 11, units 13, 14 and 15 as three continuous aggregate feeding means for feeding three kinds of aggregates continuously while metering them are installed in order in a delivery direction of the main belt conveyor unit 11. Since the continuous aggregate supply units 13 to 15 are substantially the same, one of them will be described.

The continuous aggregate supply unit 13 is provided with a belt conveyor unit 13*a*. A vibrating feeder 13*b* as a unit for delivering the material is installed at an inlet end of this belt conveyor unit 13*a*. Further, a hopper 13*c* for feeding the aggregate to the feeder 13*b* is provided above the vibrating feeder 13*b*. A belt scale unit 13*d* for metering a local weight of the delivery belt that is continuously moving carrying the aggregate is installed downstream of the vibrating feeder 13*b* in the belt conveyor unit 13*a*.

This belt scale unit 13*d* is adapted to continuously detect the local weight of the delivery belt moving and carrying the aggregate by means of a load cell (not shown) and at the same time to output an electric signal to a control unit (not shown). The control unit calculates continuously a weight value from the signal detected by the load cell and output, and calculates the amount of the aggregate fed out currently for, for example, every several minutes by multiplying the weight value by the velocity of the delivery belt.

When the supply amount of the aggregate is more or less than a predetermined amount, an operational frequency of the vibrating feeder 13*b* is varied to change its frequency by the control unit, whereby the delivery amount of the aggregate, i.e., the supply amount thereof is fed back and controlled. The three kinds of the aggregates such as two different size small stones, sand etc., for example, are fed in order to the first main belt conveyor unit 11 from the three continuous aggregate supply units 13 to 15 while the predetermined supply amount thereof per unit time is being controlled.

When the three kinds of the materials to be carried and delivered in order in a stratified condition on the delivery belt of the first main belt conveyor unit 11 are transferred to the second main conveyor unit 12 installed horizontally and moved to the delivery outlet end thereof, mortar or cement paste is continuously fed onto the delivery belt by a unit 16 installed in the midway thereof for continuously feeding a predetermined amount of the mortar.

As shown in FIG. 2 in more detail, this continuous fixed amount supply unit 16 is provided with a screw shaft 16*b* arranged rotatably within the interior of a sleeve-like casing 16*a*. This screw shaft 16*b* is rotated by a drive motor 16*d* installed on a base 16*c*. A hopper 16*e* is provided above one end portion of the casing 16*a*. An outlet portion on the lower side is connected to a cast port formed in the casing 16*a*.

Thus, the mortar or cement paste that has been introduced into the hopper 16*e* is introduced from the cast port of the casing 16*a* into the interior, extruded through the casing 16*a* by the rotating screw shaft 16*b* and fed onto the delivery belt through a supply pipe 16*f* from the other outlet. In feeding the mortar or cement paste, in order to feed continuously more preferable amount of the mortar or cement paste in proportion to the total amount of the three kinds of aggregates to be fed by the delivery belt, a belt scale unit 17 is installed on the upstream side of the supply port of the supply pipe 16*f*.

Since this belt scale unit 17 is substantially the same as the above-described belt scale unit 13*d*, the explanation of the structure will be omitted. However, in operation, the unit is adapted to continuously detect the local weight of the delivery belt in the second main conveyor belt unit 12 moving carrying the three kinds of aggregates by a load cell (not shown) of the belt scale unit 17 and to output an electric signal to a control unit 18.

The control unit 18 continuously calculates, for example the total supply amount of the three kinds of aggregates per unit time from the signals detected and output by the load cell, and calculates a more correct supply amount of the mortar per unit time from this calculation result. Then, in response to the total supply amount of the aggregates per unit time, the control unit 18 changes the rpm speed of the drive motor 16*d* to change the rotational speed of the screw shaft 16*b* to thereby control the supply of the mortar or cement paste.

Thus, even if the total supply amount of the three kinds of aggregates per unit time, carried and transferred on the delivery belt in the second main belt conveyor unit 12 is varied (that is, even in the case where the amount of the aggregates on the delivery belt is increased or decreased), it is possible to feed the suitable amount of mortar or cement paste for the total supply amount of the aggregates on the delivery belt passing below the outlet portion of the supply pipe 16*f*. As a result, the quality of the produced concrete is more improved.

One mixing box unit 20 is installed just below the delivery end of the second main belt conveyor unit 12. Six, in total, two kinds of elements 21A and 21B are basically connected to each other in the vertical direction in this mixing box unit 20. For the sake of explanation, there is shown a state in which these two kinds of elements 21A and 21B are connected to each other.

A specific structure of each element 21A, 21B will now be described. First of all, one of the elements 21A is provided at both ends with square end portions, and flanges F for connecting the elements to each other are formed at both the end portions.

A plurality of bolt holes fl are formed in these flanges F, F. The adjacent elements are fixed at ends by bolts to each other and connected to each other by utilizing the bolt holes f1. The element 21A is provided with two modified passages 22, 23 arranged in parallel in the same direction. A partitioning wall 24 is formed in the central portion so as to form the longitudinal openings on the right and left sides at one end portion of this element 21A.

These right and left longitudinal openings are inlet portions 22*a*, 23*a* of the two modified passages 22, 23, respectively. A partitioning wall 25 is provided in the center of the other end portion of the element 21A so as to form the horizontally extending openings on the upper and lower sides. The horizontally extending upper and lower openings are respective outlet portions 22*b* and 23*b* of the two modified passages 22, 23. Namely, the partitioning wall 24 at the inlet end portion of the element 21A and the partitioning wall 25 at the outlet end portion of the element 21A are disposed at 90 degrees to each other.

Accordingly, in the arrangement pattern of the two inlets 22*a*, 23*a* of the modified passages 22 and 23, the rectangular openings are formed in parallel on the right and left sides, whereas in the arrangement pattern of the two outlets 22*b*, 23*b*, the rectangular openings are formed in parallel on the upper and lower sides. The specific shape of the modified passages 22, 23 will be described. The respective modified passages 22, 23 are arranged with the respective cross-sectional shapes thereof being continuously varied toward the outlets 22*b*, 23*b* from the inlets 22*a*, 23*a*.

In the state of the variation, either of the modified passages 22, 23 has kept constant its cross-sectional area at any position but has changed only the shape in cross-section from the inlets 22*a*, 23*a* to the outlets 22*b*, 23*b*. Namely, the inlets 22*a*, 23*a* have a longitudinal rectangular shape in an X-direction, the cross sectional shape is formed into a square in an intermediate portion between the inlets 22*a*, 23*a* and the outlets 22*b*, 23*b*, and the outlets 22*b*, 23*b* have a longitudinal rectangular shape in a Y-direction perpendicular to the X-direction (see FIG. 3). Then, the length of the modified passages 22, 23 is kept constant.

Accordingly, the object material to pass through the respective modified passages 22, 23 is changed in cross-sectional shape gradually from the longitudinal rectangular shape in the X-direction gradually to the square shape, and further to the longitudinal rectangular shape in the Y-direction, gradually. In this element 21A, as viewed in FIG. 3, the inlet 22*a* located on the left side and the outlet 22*b* located in the upper side are in communication with each other through the modified passage 22, whereas the inlet 23*a* located on the right side and the outlet 23*b* located on the lower side are in communication with each other through the modified passage 23.

Next, the other kind of element 21B has the same arrangement as that of the above-described element 21A. However, in this element 21B, as viewed in FIG. 3, an inlet 26*a* located on the left side and an outlet 26*b* located in the lower side are in communication with each other through a modified passage 26, whereas an inlet 27*a* located on the right side and an outlet 27*b* located on the upper side are in communication with each other through a modified passage 27. Namely, this element 21B has a different communication state from that of the element 21A with each inlet and each outlet of each modified passage.

FIG. 3 shows the condition where such two kinds of elements 21A and 21B are connected to each other. Namely, in the above-described two kinds of elements 21A and 21B, the inlet end portion of the one element 21B is connected to the outlet end portion of the other element 21A with the flanges F in intimate contact with each other with bolts.

Accordingly, in the joint portion between the two kinds of elements 21A and 21B, the outlet 22*b* of the modified passage 22 in the one element 21A is in communication with the half of the inlet 26*a* of the modified passage 26 and the half of the inlet 27*a* of the other modified passage 27 in the other element 21B, whereas the outlet 23*b* of the modified passage 23 in the one element 21A is in communication with the rest half of the inlet 26*a* of the modified passage 26 and the rest half of the inlet 27*a* of the other modified passage 27 in the other element 21B.

For this reason, each half of the object material to be mixed that has passed through each modified passage 22, 23 in the one element 21A is introduced into each modified passage 26, 27 of the other element 21B to be merged substantially. However, with respect to the object material that has passed through one modified passage, it is divided to each half at the joint portion of the two elements.

Accordingly, each outlet and each inlet of each modified passage formed in the outlet end portion and the inlet end portion that are the joint portion between the two elements 21A, 21B constitute the merging and dividing means of the object material. As shown in FIG. 1, if such elements 21A and 21B are connected to each other in series, the merging and dividing means for the object material is formed in each joint portion.

The aggregate and mortar transferred by the second belt conveyor unit 12 are dropped continuously into a hopper 19 from its delivery end. The aggregate and mortar are roughly mixed when they are dropped from the second belt conveyor unit 12 into the hopper 19. Under this condition, the aggregate and mortar are introduced from the two inlet portions 22*a*, 23*a* in the first element 21A of the mixing box unit 20 into each modified passage 22, 23 to drop into the mixing box unit 20 by the gravitational force.

The mixing process of the object material (aggregate and mortar) flowing downwardly through the mixing box unit 20 will now be described with reference to FIG. 4 showing the process views. Incidentally, these process views show in a model graphic manner the changing state of the object material, i.e., the aggregate and mortar in the regions of the inlet end portion, the intermediate portion and the outlet end portion of each element 21A, 21B in the case where the two elements 21A, 21B are connected to each other (in two stages).

As is apparent from FIG. 4, the object material fed into the hopper 19 is introduced into the two modified passages 22, 23 at the inlet end portion of the first stage element 21A, and as a result, the flow thereof is divided into the two A, B. The cross-sectional shape of each fluidized object material thus divided is in the form of a longitudinal rectangular shape in the X-direction.

Subsequently, in the first stage intermediate portion, the cross-sectional shapes of the fluidized object materials A, B are both changed into a square shape. Furthermore, the shapes are both changed into a rectangular shape long in the Y-direction at 90 degrees to the longitudinal direction X on the inlet side in the first stage outlet end portion. Accordingly, the cross-sectional shape of each fluidized object material A, B is changed from the rectangular shape long in the X-direction, to a square shape and to the rectangular shape long in the Y-direction.

In this varying process, the material is subjected to the continuous compression effect by the inner wall of each modified passage 22, 23. As a result, a continuous convection phenomenon occurs in particular in a radial direction of the cross-section in the fluidized object material to thereby perform the primary kneading effect.

Subsequently, since a partitioning wall 28 at the inlet end portion of the second stage element 21B intersects perpendicular with the partitioning wall 15 at the outlet end portion of the first stage element, as shown in FIG. 4, the object materials A and B fed out of the outlet end portion of the first stage element 21A are divided into the right and left, respectively, and divided into A/B and A/B.

Then, the object materials A/B are caused to flow through the respective modified passages 26 and 27, respectively. Namely, at the inlet end portion of the second stage element 21B, parts of the object materials A, B are merged into the respective modified passages 26, 27 and the cross-sectional shape of the fluidized object material within each passage is formed into a rectangular shape long in the X-direction.

Subsequently, in the second stage intermediate portion, the cross-sectional shapes of the fluidized object materials A/B are changed into a square shape as a whole and the shape is changed into the longitudinal rectangular shape in the Y-direction at the outlet end portion. Also, in the second stage, the object material A/B is changed from the longitudinal rectangular shape in the X-direction through the square shape into the longitudinal rectangular shape in the Y-direction.

Then, in the varying process, the material is subjected to the continuous compression effect by the inner surface of each modified passage 26, 27. As a result, a continuous convection phenomenon occurs in particular in a radial direction of the cross-section in the fluidized object material to thereby perform the secondary kneading effect.

With respect to the third stage, although not particularly shown, at the third stage inlet end portion, the final object material at the second stage outlet end portion shown in FIG. 4 is divided on the right and left sides and merged into A/B/A/B as shown by the phantom line X1. The object material at the stages afterward is kneaded in the same way as the first stage and the second stage.

By the way, in this embodiment, as described above, the two different kinds of elements 21A and 21B are connected alternately to each other. The reason therefor will now be described. As each modified passage of the element 21A shown in FIG. 3 is viewed from one end portion, the portions except the hatched portions shown in FIG. 5 are observed as a straight through-hole.

Since the inlet 22*a* on the left side in the inlet end portion is in communication with the upper outlet 22*b* in the outlet end portion and the inlet 23*a* on the right side in the inlet end portion is in communication with the lower outlet 23*b* in the outlet end portion as described above, it goes without saying that the regions where these portions are partially overlapped with each other may be seen directly from the inlet to the outlet.

If so, with respect to the passage portion that is present in the regions where the inlets 22*a* 23*a* and the outlets 22*b*, 23*b* are partially overlapped with each other when viewed in the longitudinal direction of the element 21A, the fluidized object material is caused to pass with almost no deformation. Then, even if the plurality of elements 21A having the same shape are connected to each other, the condition as the modified passage is viewed from the end portion is not different from the condition shown in FIG. 5 at all. Accordingly, it is possible to predict the case where the kneading effect is not so attained even if the plurality of elements having the same shape are connected to each other. the end portion is not different from the condition shown in FIG. 5 at all. Accordingly, it is possible to predict the case where the kneading effect is not so attained even if the plurality of elements having the same shape are connected to each other.

On the other hand, with respect to the element 21B, for the same reason as the explanation of the above-described element 21A, the regions where the inlets 26*a,* 27*a* and the outlets 26*b,* 27*b* are overlapped with each other are the portions except for the hatched portions shown in FIG. 6. This is apparent unlike the element 21A, since the inlet 26*a* on the left side in the inlet end portion is in communication with the lower outlet 26*b* in the outlet end portion and the inlet 27*a* on the right side in the inlet end portion is in communication with the upper outlet 27*b* in the outlet end portion.

Therefore, assuming that these two kinds of elements 21A, 21B are connected as shown in FIG. 3, it is possible to obtain the condition as if FIGS. 5 and 6 were overlapped when the modified passages are viewed from the inlet end portion. As a result, it is impossible to directly see the outlet portion from the inlet portion. This means that the object material that has been fed from the inlet portion would not flow to the outlet portion in a so-called straight manner. As a result, it is possible to further enhance the mixing effect.

Incidentally, the elements used in the above-described embodiment are provided with the two modified passages 22, 23 or 26, 27. However, it is possible to constitute the mixing box unit by connecting the elements 30 having four modified passages 31, 32, 33 and 34 as shown in FIG. 7.

The idea of this element 30 is the same as that of the elements 21A, 21B described above. The element is also provided with square openings at the end portions and flanges F for connection around the openings. Furthermore, the inlet end portion is partitioned by means of three partitioning walls 35, 36, 37 so as to form four longitudinal openings in the X-direction to form inlets 31*a,* 32*a,* 33*a,* 34*a* of the four modified passages 31 to 34.

On the other hand, the outlet end portion of the element 30 is partitioned so as to have longitudinal openings in the Y-direction different by 90 degrees from each inlet of the inlet end portion by three partitioning walls 38, 39, 40 to form outlets 31*b,* 32*b,* 33*b,* 34*b* of each modified passage.

Then, as viewed in FIG. 7, the inlet 31*a* of the modified passage 31 is in communication with the second outlet 31*b* from above, the inlet 32*a* of the modified passage 32 is in communication with the uppermost outlet 32*b,* the inlet 33*a* of the modified passage 33 is in communication with the lowermost outlet 33*b,* and the inlet 34*a* of the modified passage 34 is in communication with the third outlet The change in the cross-sectional shape in the longitudinal direction of each modified passage 31, 32, 33, 34 is basically the same as that of the elements 21A, 21B in the foregoing embodiment. However, the different point is that there are four modified passages in the contour of the element 30 as a whole.

FIG. 8 is a view showing a mixing method using the mixing box unit constituted by connecting the two elements 30 to each other (by connecting the elements 30 having the same shape in this example) When the object material that has been introduced into the inlets 31*a* to 34*a* longitudinal in the X-direction at the inlet end portions of the first stage element 30 is discharged from the outlets 31*b* to 34*b,* the object material is divided into B, A, D, C, and each row is merged in the condition of the sixteen layers longitudinal in the X-direction at the outlet end portions of the second stage element 30. Here, phantom lines X3 designate the next third division lines.

Thus, the suitably measured amount of aggregate and mortar or cement paste are continuously fed to the mixing box unit 20 to be mixed suitably, as a result of which very high quality concrete may be continuously produced. In the continuous concrete manufacturing plant 10 in accordance with the above-described embodiment, the belt scale units are installed in the continuous frame material supply units 13 to 15 for producing a relatively high quality concrete as described above, supervising continuously the supply amount of the frame material and performing the feedback control. Also, in the same manner, the supply of the mortar is very accurately adjusted so as to be in proportion to the total amount of the frame material that has been delivered. However, such belt scale units may be suitably installed in response to the quality of the demanded concrete quality.

Incidentally, in the case where the material such as aggregate or mortar is caused to pass through the mixing box unit 20, the material is not always passed while filling the modified passage of each element. If the object material is not passed through the modified passage of each element while filling the modified passage, there is a fear that the material is not subjected to the shear or compression during the passage of the mixing box unit due to the difference of kinds of materials. As a result, there is a possibility that the difference occurs in kneaded condition.

For this reason, it is preferable that an openable/closeable cut gate (not shown) is provided at the lowermost element outlet constituting the mixing box unit 20, and the discharge amount of the material dropping by the gravitational force is adjusted so as to more effectively perform the kneading and mixing under the control of the filling rate of the material in the modified passage in each element of the mixing box unit.

Also, an amount (volume) of the aggregate per unit time that has been continuously fed by, for example, the delivery belt or the various well known means other than the belt scale unit as a means for adjusting a supply of the aggregate and mortar or cement paste may be detected in order by a plurality of photoelectric tubes or it is possible to control the supply amount of the material by using a well known feed conveyor unit with high precision.

Furthermore, in the above-described continuous mixing plant in accordance with the embodiment, one kind or more kinds of materials are loaded and transferred so as to overlap in order on the delivery belt of the main conveyor unit. Furthermore, the final material is loaded on the delivery belt after determining the total amount of materials and these materials are cast into the mixing box unit. However, the present invention is not limited thereto.

Namely, for instance, as shown in FIG. 9, continuous aggregate supply units 13, 14, 15 and the continuous fixed amount supply unit 16 for feeding mortar or cement paste are provided independently around the hopper 19 installed in the upper portion of the mixing box unit 20 and each material may be cast continuously into the hopper 19 from each unit while metering the material. Then, a scale is installed in the delivery path from each continuous aggregate supply unit 13, 14, 15 and the continuous fixed amount supply unit 16 to the hopper 19, and the respective continuous aggregate supply units 13, 14, 15 and the continuous fixed amount supply unit 16 are subjected to the feedback control to thereby enhance the material supply precision as described above, if necessary.

Also, in the above-described embodiment of the present invention, the example in which the aggregate and the mortar are mixed to manufacture the concrete has been explained. However, the present invention is not limited to such materials. It is possible to cast the aggregate and the cement paste into the mixing box unit while continuously feeding and metering the materials, respectively.

Also, in the above-described embodiment, the object material has been described by using the term of "aggregate". However, the "aggregate" used here is not limited to the kinds independent of each other such as sand or small stone. Namely, the material obtained by mixing the sand and small stone in advance or the material obtained by further mixing the cement powder to the sand or small stone or the mixture thereof in advance is called a premix. The "aggregate" also includes the concept of such premix. Accordingly, it is possible to cast such premix into the mixing box unit while continuously metering and feeding the material.

In particular, in the case where the premix obtained by mixing the cement powder to the mixture of the sand and small stone in advance is cast into the mixing box unit while continuously metering and feeding, as shown in FIG. 10, two mixing box units 20 may be provided stepwise. Namely, the sand that is fine aggregate, the small stone that is the coarse aggregate and the cement powder are continuously fed by the metering and supply units 113, 114, 115 and mixed in the first stage mixing box unit 20 to manufacture the premix.

Subsequently, water is continuously fed to this premix by a water supply unit 116 and mixed in the second stage mixing box unit 20. Also through such a process, it is possible to manufacture the concrete continuously. As is understood also from this, according to the present invention, it is possible to install the plurality of mixing box units in the stepwise manner as required and to mix materials while feeding each material in order.

Incidentally, the management of the surface water of the coarse aggregate material or fine aggregate is needed in the case where the high quality concrete is to be manufactured, including the case where the water is to be added to the above-described premix. It is therefore preferable to add a water supply control unit or a moisture detecting means to the above-described continuous mixing plant according to the present invention, if necessary.

Incidentally, in the foregoing embodiment of the present invention, the plant is used for continuously producing the concrete. It goes without saying that the present invention may be applied to various cases where each material to be mixed is fed while being measured and is mixed and agitated continuously to obtain the product. It is possible to exemplify as such use the manufacture of mixed feed for domestic animals or gardening ground (mixed ground of ground and hen droppings).

As described above, in the continuous mixing plant according to the present invention, it is possible to perform the manufacture of the mixed material in a relatively simple apparatus and continuously and relatively high speed to thereby considerably enhance the manufacturing efficiency of the mixed material, as a result of which it is possible to produce such a mixed material in a mass-production manner.

Also, in the continuous mixing plant according to the present invention, it is possible to perform this to the continuous manufacture of the concrete. In this case, the metering of each material that has been conventionally difficult to perform in the continuous manufacture of the concrete may be continuously performed with high precision and the material is fed to the mixer having a special structure. Thus, there is an excellent advantage that the high quality concrete may be manufactured continuously at a high speed.

INDUSTRIAL APPLICABILITY

The present invention is applicable to an apparatus for continuously mixing and agitating several kinds of materials, for example, for mixing cement and coarse aggregate in a concrete manufacturing plant or the like, mixing feed for domestic animals or mixing ground and hen droppings for producing gardening ground.

What is claimed is:

1. A continuous mixing plant comprising:

a main belt conveyor unit for delivering aggregate;

a continuous aggregate feeding means for keeping on feeding at least one kind of aggregate to said main belt conveyor unit while metering the material;

a first detecting unit installed downstream of a delivery belt of said main belt conveyor unit for metering continuously at a predetermined position a local amount of said aggregate that has been transferred on said delivery belt of said main belt conveyor unit, thereby outputting a signal;

a continuous fixed amount supply means installed downstream of said main belt conveyor unit having said aggregate fed for keeping on feeding a fixed amount of mortar or cement paste continuously to said main belt conveyor unit; and at least one mixing box unit disposed just below a delivery end of said main belt conveyor unit, characterized in that said continuous fixed amount supply unit receives said signal continuously output from said first detecting unit and is feedback-controlled to enhance precision of the supply amount of the mortar or cement paste, and that, furthermore, said mixing box unit is provided with: a plurality of modified passages each of which has an inlet portion at one end and an outlet portion at the other end, a cross-sectional shape of which is continuously changed from said inlet portion toward said outlet portion, and which extend in an axial direction; and a merging and dividing means provided between said inlet portion and said outlet portion of each of said modified passages for merging and dividing concrete passing through each of said modified passages, and concrete is cast from said inlet portion and passed toward said outlet portion through each of said modified passages by the gravitational force to be mixed.

2. The continuous mixing plant according to claim 1, characterized in that said continuous aggregate feeding means includes:

a belt conveyor unit for feeding the aggregate to said main conveyor unit;

a material cutting unit for continuously feeding said aggregate to said belt conveyor unit; and a second detecting unit installed downstream of said belt conveyor unit so as to output a signal by continuously metering at a predetermined position an amount of said aggregate that is transferred on the delivery belt of said belt conveyor unit, said material delivering unit being feedback-controlled upon receiving said signal continuously output from said second detecting unit, to thereby enhance precision of the supply amount of the aggregate delivered and fed to said belt conveyor unit.

3. The continuous mixing plant according to claim 2, characterized in that said material delivering unit includes a vibrating feeder, and a frequency of said vibrating feeder is changed on the basis of the signal continuously output from said second detecting unit to feedback-control the delivering amount of said aggregate to said belt conveyor unit.

4. The continuous mixing plant according to claim 3, characterized in that one or both of said first and second detecting units are composed of a belt scale unit for continuously metering a weight of the delivery belt and the aggregates thereon at a predetermined position.

5. The continuous mixing plant according to claim 4, characterized in that said mixing box unit is constituted by connecting a plurality of elements substantially in a vertical direction, each of said elements is provided with an inlet end, an outlet end and the plurality of modified passages stretching from said inlet end to said outlet end, the inlet of each of said modified passages formed at the inlet end and the outlet of each of said modified passages formed at said outlet end have different arrangement patterns, furthermore, each adjacent elements are connected in intimate contact with each other at said outlet end and said inlet end, and a joint portion between the inlet and the outlet of each of said modified passages on the end portion of the joint side of each of said elements constitutes said merging and dividing means.

6. The continuous mixing plant according to claim 5, characterized in that said elements are provided with rectangular openings being arranged on the right and left sides as an arrangement pattern of said inlet of each of said modified passages and with rectangular openings being arranged vertically as an arrangement pattern of said outlet of each of said modified passages, and are constituted of at least two kinds to differentiate the communication state between each inlet and each outlet of each of the modified passages, and said mixing box unit is constituted by connecting alternately the different kinds of said elements with each other in the vertical direction.

7. The continuous mixing plant according to claim 6, characterized in that an openable/closeable cut gate is provided at an outlet of the lowermost element constituting said mixing box unit, and a discharge amount of material dropping by a gravitational force is adjusted, whereby a control of a filling rate of the material in the modified passage of each element of said mixing box unit is performed.

* * * * *